US007832839B2

(12) United States Patent
McCabe et al.

(10) Patent No.: US 7,832,839 B2
(45) Date of Patent: Nov. 16, 2010

(54) INKJET PRINT CARTRIDGE

(75) Inventors: Declan John McCabe, Meath (IE); Laura Annett, Bawnogue Clondalkin (IE); Philip Thomas Keenan, Dublin (GB); John Breen, Leixlip (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 672 days.

(21) Appl. No.: 11/547,968

(22) PCT Filed: Apr. 15, 2005

(86) PCT No.: PCT/EP2005/051681

§ 371 (c)(1),
(2), (4) Date: Aug. 30, 2007

(87) PCT Pub. No.: WO2005/102709

PCT Pub. Date: Nov. 3, 2005

(65) Prior Publication Data

US 2008/0129803 A1 Jun. 5, 2008

(30) Foreign Application Priority Data

Apr. 23, 2004 (GB) ..... 0409001.5

(51) Int. Cl.
*B41J 2/14* (2006.01)

(52) U.S. Cl. ..... 347/50

(58) Field of Classification Search ..... 347/49, 347/50, 58, 59, 63, 87
See application file for complete search history.

(56) References Cited

U.S. PATENT DOCUMENTS

| | | | | |
|---|---|---|---|---|
| 4,727,384 | A * | 2/1988 | Tsuda | 347/50 |
| 4,940,413 | A * | 7/1990 | Childers et al. | 439/67 |
| 5,278,584 | A * | 1/1994 | Keefe et al. | 347/63 |
| 5,798,780 | A * | 8/1998 | Koizumi et al. | 347/50 |
| 6,328,423 | B1 | 12/2001 | Wong et al. | |
| 6,663,224 | B2 * | 12/2003 | Rivas et al. | 347/47 |
| 2002/0145646 | A1 | 10/2002 | Sullivan et al. | |
| 2003/0030696 | A1 | 2/2003 | Sato et al. | |
| 2003/0035027 | A1 | 2/2003 | Vander Plas et al. | |

FOREIGN PATENT DOCUMENTS

| | | |
|---|---|---|
| DE | 198 32 369 | 1/2000 |
| EP | 0 566 249 | 10/1996 |
| EP | 0 885 721 | 12/1998 |
| EP | 1 170 129 | 1/2002 |
| JP | 09-001803 | 1/1997 |

* cited by examiner

*Primary Examiner*—Anh T. N. Vo

(57) ABSTRACT

A method of making an inkjet print cartridge comprises forming a cartridge body (30) and applying directly to the surface of the body first and second sets of electrical terminals (40*a*, 42*a*) selectively connected by conductive tracks (44). A printhead (68) is mounted to the body (30) in electrical connection with the first set of terminals (40*a*). The second set of terminals (42*a*) is adapted for electrical connection to printer circuitry. The electrical terminals and conductive tracks may be located in corresponding recesses in the cartridge body, being deposited therein by squeegee or inkjet printing.

20 Claims, 10 Drawing Sheets

INKJET PRINT CARTRIDGE

TECHNICAL FIELD

This invention relates to inkjet print cartridges and methods of making them.

BACKGROUND ART

FIG. 1 is a simplified view of a conventional prior art inkjet cartridge. It comprises a moulded plastics cartridge body 10 containing one or more internal ink reservoirs. A printhead 12 is mounted in a recess 14 in the surface of the body 10. As is well known, a typical printhead 12 contains a large number of internal ink ejection elements which can be selectively actuated by printer circuitry via a flexible printed circuit 16 bonded to the surface of the cartridge body. Each time an ink ejection element is actuated, a drop of ink is ejected forcibly through a respective orifice 18 in the exposed (outer) surface of the printhead. The ink is supplied to the printhead via one or more ink supply slots in the underside of the printhead which are in fluid communication with the ink reservoirs) via respective apertures in the cartridge body 10.

The flexible printed circuit 16 is shown flat in FIG. 2 although in use it is usually bent around two sides of the cartridge body 10 as seen in FIG. 1. The view in FIG. 2 is of the underside of the flexible printed circuit, i.e. the surface bonded to the cartridge body 10 in FIG. 1. The underside of the flexible printed circuit 16 comprises a first set of electrical terminals 20 and a second set of electrical terminals 22. In the simplified diagrams of FIGS. 1 and 2 only eight terminals are shown in each set, but in practice there will many more, typically 20 terminals in each set. The terminals 20 of the first set are disposed along opposite edges of an aperture 24 in the flexible printed circuit 16, and each is in the form of a respective cantilevered metal beam ("flex beam") which extends into the aperture 24. The terminals 22 of the second set extend through the thickness of the material of the flexible printed circuit to be accessible on the outside surface of the flexible printed circuit, as seen in FIG. 1. The flex beams 20 are selectively connected to the terminals 22 via conductive tracks 26 on the underside of the flexible printed circuit.

The conventional printhead 12 has two rows of edge contacts on its outer surface, i.e. on the same side of the printhead as the orifices 18, and in the assembled cartridge with the printhead 12 seated in the recess 14 each edge contact is electrically connected to a respective one of the flex beams 20 (for simplicity, the edge contacts and flex beams are not shown in FIG. 1). When the cartridge is inserted into a compatible printer, the electrical terminals 22 mate with corresponding electrical terminals of the printer circuitry, so that the latter can selectively actuate the ink ejection elements via the conductive tracks 26 and flex beams 20 in known manner.

The conventional inkjet cartridge described above has certain disadvantages. Since the connections between the edge contacts of the printhead and the flex beams 20 are made at the outer surface of the printhead, the print head has to be attached to the flexible printed circuit 16 before the latter is attached to the cartridge body 10. Rework of the assembly is therefore very difficult. Furthermore, the construction is complex and costly.

U.S. Pat. No. 6,328,423 discloses a method of making an inkjet print cartridge in which a cartridge body is provided having a plurality of channels, recessed into the surface of the body, extending between a first set of terminal regions and a second set of terminal regions. The channels are filled with a conductive material to form first and second sets of electrical terminals selectively interconnected by conductive tracks, the first set of terminals being adapted for electrical connection with a printhead, and the second set of terminals being adapted for electrical connection to printer circuitry.

SUMMARY OF THE INVENTION

According to a first aspect the present invention provides a method of making an inkjet print cartridge comprising providing a cartridge body and selectively applying conductive material directly to the surface of the body to form first and second sets of electrical terminals selectively interconnected by conductive tracks, the first set of terminals being adapted for electrical connection with a printhead and the second set of terminals being adapted for electrical connection to printer circuitry, wherein at least a portion of the conductive material is applied to the body by inkjet printing.

According to a second aspect the present invention provides a method of making an inkjet print cartridge comprising providing a cartridge body having a plurality of channels extending between a first set of terminal regions and a second set of terminal regions, the channels and terminal regions being recessed in the surface of the body, depositing a conductive material in the recessed terminal regions and channels, and plating the conductive material, the plated conductive material forming first and second sets of electrical terminals selectively interconnected by conductive tracks, the first set of terminals being adapted for electrical connection with a printhead and the second set of terminals being adapted for electrical connection to printer circuitry.

According to a third aspect the present invention provides a method of making an inkjet print cartridge comprising providing a cartridge body having a plurality of channels extending between a first set of terminal regions and a second set of terminal regions, the channels and terminal regions being recessed in the surface of the body, and depositing a conductive material into the recessed terminal regions and channels, the conductive material forming first and second sets of electrical terminals selectively interconnected by conductive tracks, the first set of terminals being adapted for electrical connection with a printhead and the second set of terminals being adapted for electrical connection to printer circuitry, wherein at least a portion of the conductive material is squeegeed into the recessed terminal regions and channels through a stencil.

The invention avoids the need for a flexible printed circuit, and allows a printhead, for example of the kind described in our copending British patent application No. 0401943.6 (HP Ref: PD No. 200315512 Attorney ref: pg10142ie00), to be directly connected to the first set of electrical terminals.

As used herein, the terms "inkjet", "ink supply slot" and related terms are not to be construed as limiting the invention to devices in which the liquid to be ejected is an ink. The terminology is shorthand for this general technology for printing liquids on surfaces by thermal, piezo or other ejection from a printhead, and while one application is the printing of ink, the invention will also be applicable to printheads which deposit other liquids in like manner, for example, liquids intended to form conductors and resistors in miniature electrical circuits.

Furthermore, the method steps as set out herein and in the claims need not be carried out in the order stated, unless implied by necessity.

BRIEF DESCRIPTION OF THE DRAWINGS

Embodiments of the invention will now be described, by way of example, with reference to the accompanying drawings, in which.

DESCRIPTION OF PREFERRED EMBODIMENTS

Figure 3:
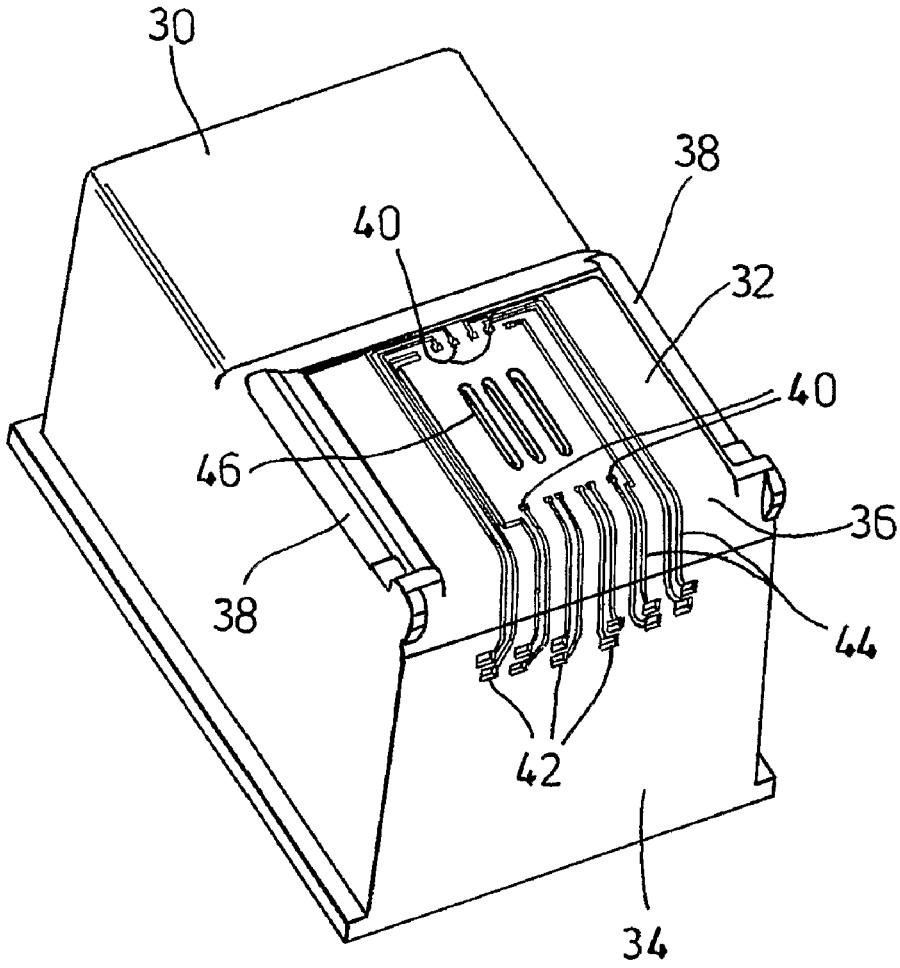
FIG. 3 is a perspective view of a moulded cartridge body used in embodiments of the invention.
Figure 4:
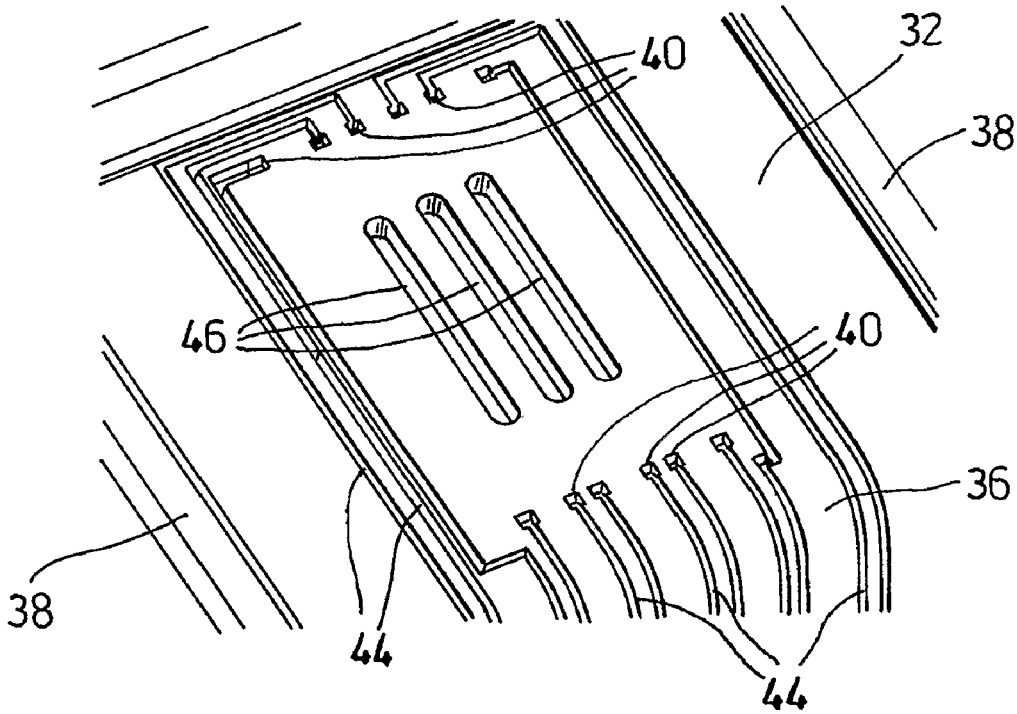
FIG. 4 is a close up of part of the surface of the cartridge body of FIG. 3.

FIG. 3 is a perspective view of a cartridge body 30 used as the starting point in methods according to the embodiments of the invention. FIG. 4 is a close up of part of the surface of the same cartridge body 30. The body 30 is moulded from a plastics material and has first and second substantially flat surface portions 32, 34 respectively which are substantially at right angles to one another and joined by a radiused edge 36. The flat portion 32 is bounded along opposite edges by raised ridges 38 whose purpose will be described later. Recessed into the surface of the body 30, and formed therein as part of the moulding process, are a first set of terminal regions 40 in the surface portion 32, a second set of terminal regions 42 in the surface portion 34, and a plurality of channels 44 extending around the radiused edge 36 and selectively connecting each terminal region 40 to a respective terminal region 42. In this embodiment the channels are 200 microns wide by 200 microns deep. In the centre of the flat surface portion 32 there are three parallel ink delivery slots 46. These communicate with respective differently coloured ink supply reservoirs in the body 30, and mate with corresponding slots of a printhead ultimately to be mounted on the surface portion 32. The terminal regions 40 are disposed in two subsets, one at each end of the slots 46.

The plastics material from which the body is moulded has, in one embodiment, to withstand the reflow temperature (138 deg. C.) of a solder paste to be deposited in the terminal regions 40, 42 and channels 44. A suitable plastics materials for this purpose is polyethylene containing carbon and/or glass fibre filler. For example, polyethylene with 30% by weight glass filler will withstand temperatures in the region of 230-250 deg. C. Another suitable plastics material is poly phenyl sulphide filled with 10% by weight carbon fibre and 10% by weight glass fibre. In other embodiments the glass fibre may be replaced by miniature glass beads.

Surfactants may be added to the mix prior to moulding the plastics body to alter the wettability of the body by conductive material (solder paste, conductive ink and/or catalyst, according to the embodiment) subsequently deposited in the terminal regions and channels. Subsequent to moulding, the surface of the body can be roughened to achieve a textured finish conducive to better adhesion of the conductive material. Such roughening can be achieved mechanical etching (e.g. by sand blasting), by chemical etching (e.g. using a mixture of concentrated hydrochloric and sulphuric acids or sodium hydroxide), or by plasma etching (e.g. $O_2$, $N_2$, $NH_3$ corona discharge treatment). In addition, the surface of the polymer body, at least in the terminal regions and channels, can be coated with a mixture of alumina or silica microparticles to produce a porous surface offering a large surface area for absorbing solder paste or conductive ink, or for catalyst deposition. A surfactant may also or alternatively be added to the conductive material to increase its wettability to the plastics body.

Figure 5:
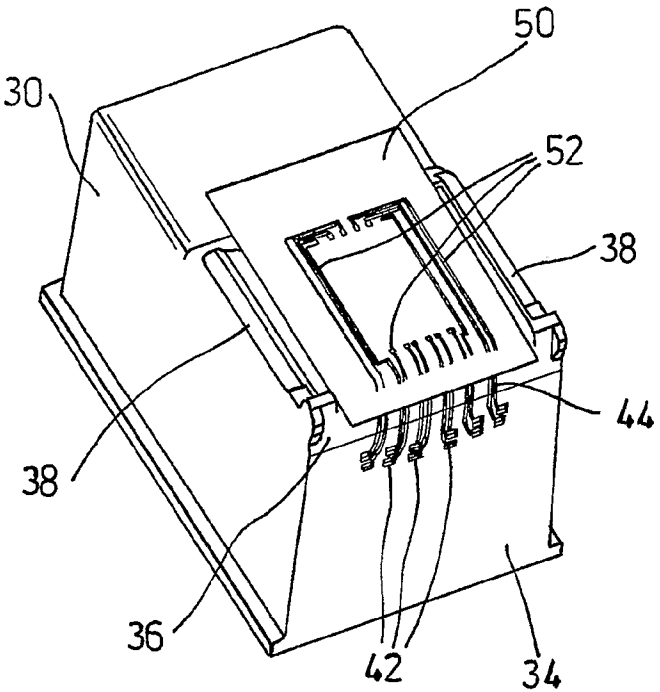

In the method according to the first embodiment the next step comprises placing a stencil 50, FIG. 5, in intimate contact with the flat surface portion 32 of the cartridge body 30 between the ridges 38. The stencil 50 has a pattern of openings 52 corresponding to and in register with the terminal regions 40 and those parts of the channels 44 in the flat surface portion 32 and around the radiused edge 36. However, the stencil has no openings corresponding to the ink delivery slots 46, which are therefore blocked off.

Figure 6:
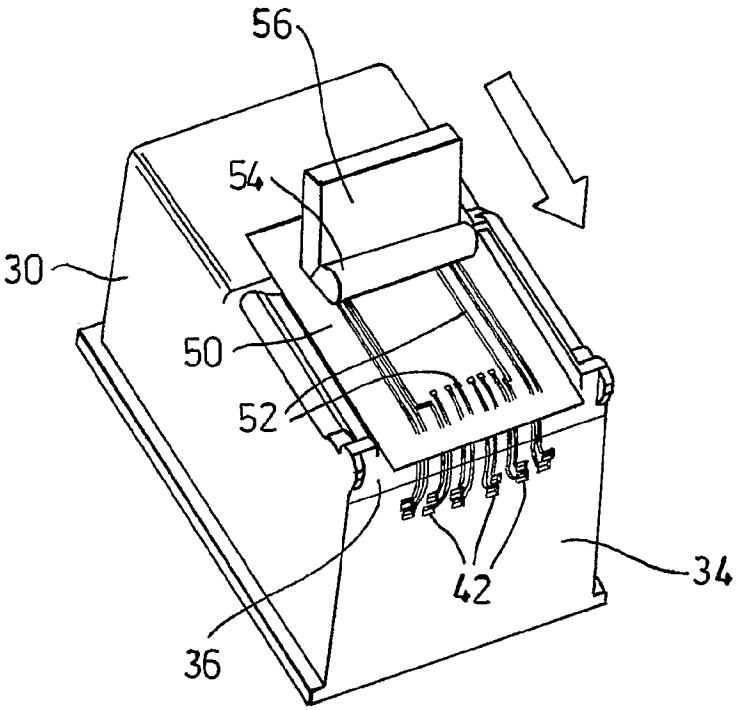
FIGS. 5 to 12 are views of the cartridge body of FIG. 3 during successive steps in a method of making an inkjet print cartridge according to a first embodiment of the invention.

Next, FIG. 6, a conductive paste is applied as a bead 54 in front of an elastomeric squeegee blade 56. The volume of paste dispensed is approximately twice the volume of the terminal regions 40 and the parts of the channels 44 to be filled. Starting from a position at the far end of the stencil 50 to the radiused edge 36, the squeegee 56 is advanced towards the radiused edge (i.e. in the direction of the arrow) forcing the conductive paste 54 through the stencil openings 52 into the terminal regions 40 and the channels 44. The pressure of the squeegee 56 is set sufficient to deform the squeegee into good contact with the stencil 50, but not so much as to significantly deform the squeegee through the stencil openings 52. At the radiused edge 36 the pressure of the squeegee deforms the stencil 52 to follow the radius at least partially around the edge 36 so that the channels 44 are correspondingly filled at last partially around the radiused edge.

Figure 7:
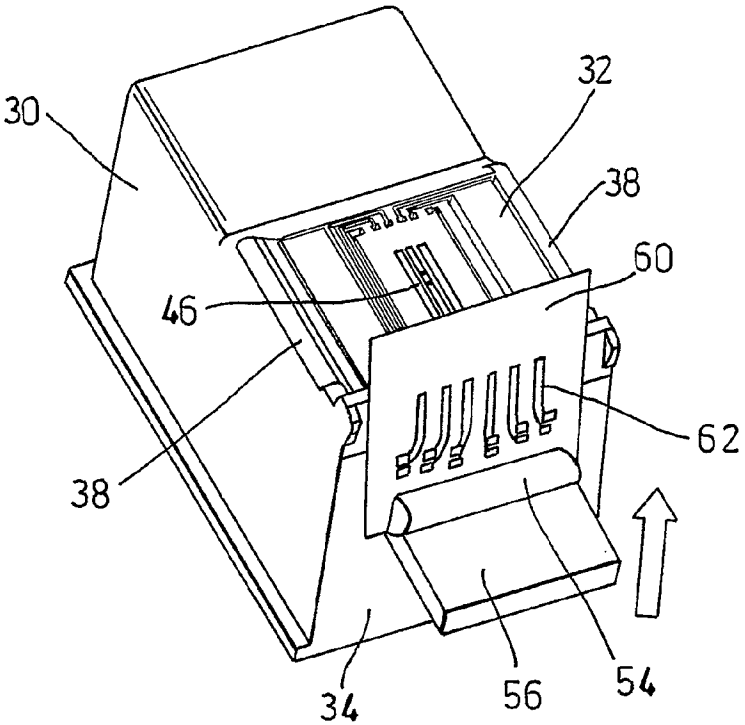

Next, FIG. 7, a second stencil 60 is placed in intimate contact with the flat surface portion 34 of the cartridge body 30. The stencil 60 has a pattern of openings 62 corresponding to and in register with the terminal regions 42 and those parts of the channels 44 in the flat surface portion 34 and around the radiused edge 36. The conductive paste 54 is again applied as a bead in front of the squeegee 56, the volume of paste dispensed being approximately twice the volume of the terminal regions 42 and the parts of the channels 44 to be filled. Starting from a position at the far end of the stencil 60 to the radiused edge 36, the squeegee 56 is advanced towards the radiused edge (i.e. in the direction of the arrow) forcing the conductive paste 54 through the stencil openings 62 into the terminal regions 42 and channels 44. The pressure of the squeegee 56 is set sufficient to deform the squeegee into good contact with the stencil 60, but not so much as to significantly deform the squeegee through the stencil openings 62. At the radiused edge 36 the pressure of the squeegee deforms the stencil 62 to follow the radius at least partially around the edge 36 so that the channels 44 are correspondingly filled at last partially around the radiused edge. The partial filling of the channels 44 around the radiused edge 36 through the stencils 50 and 60 should be such as to fill the channels 44 continuously around the radiused edge.

The stencils 50 and 60 may be any conventional screen printing stencil such as a photo-patterned polyester weave, or a laser defined stainless steel stencil, although in any case it should be sufficiently flexible to allow deformation at least partly around the radiused edge 36 as described above. After each use the stencils 50 and 60 are cleaned with a lint-free tape which passes around a roller which bears under pressure on the stencil as the roller is moved across the stencil surface.

In this embodiment the conductive paste 54 consists of copper powder, mean particle size 0.25 microns, 70% by weight, and solder paste 30% by weight. The solder paste is a mixture of flux, such as Superior Safe* No. 30 general purpose organic flux from the superior Flux and Manufacturing Company, USA, and a eutectic mixture of Tin (42% by weight) and Bismuth (58% by weight).

A heat gun (hot air blower) is now applied to the two surface portions 32, 34 of the cartridge body 30, as well as to the radiused edge 36, to heat the flux above the eutectic melting point of the solder (138 deg. C.) to cause the solder paste to melt and reflow, improving the conductivity of the paste. Typically the heat gun heats the flux to 160 deg. C. for one minute to reflow the solder. The result is a first set of electrically conductive terminals 40*a* inset in the cartridge body in the terminal regions 40, a second set of electrically conductive terminals 42*a* inset in the cartridge body in the terminal regions 42, and a plurality of electrically conductive tracks 44*a*, selectively joining the two sets of terminals, inset in the cartridge body in the channels 44.

Now, using further stencils, not shown, a UV curable encapsulant such as a phenolic resin or acrylic is applied to the cartridge body. The stencils have apertures corresponding to the tracks 44*a* but not to the terminals 40*a* and 42*a*. Thus the encapsulant is applied only to the tracks 44*a*, the terminals 40*a* and 42*a* being masked by the stencils to prevent their coverage by the encapsulant. After its application the encapsulant is exposed to UV light to cause it to permanently crosslink.

Figure 8:
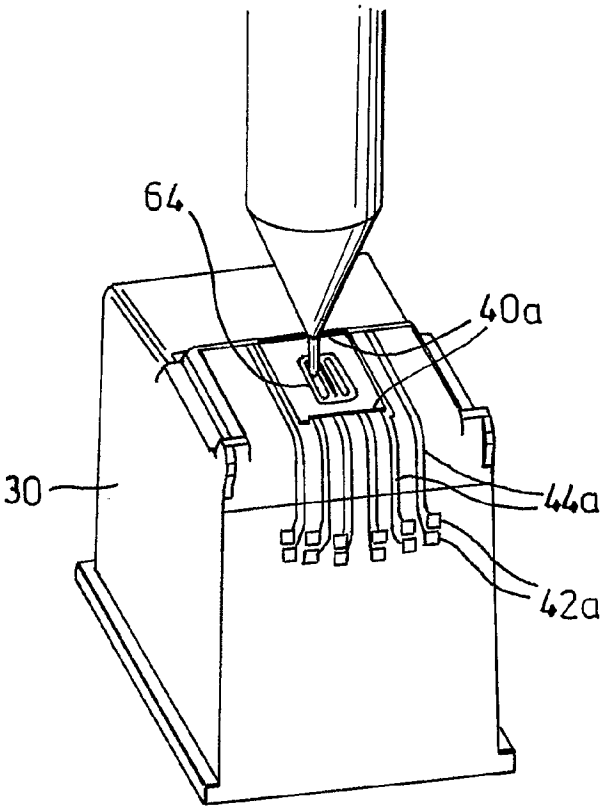
Figure 10:
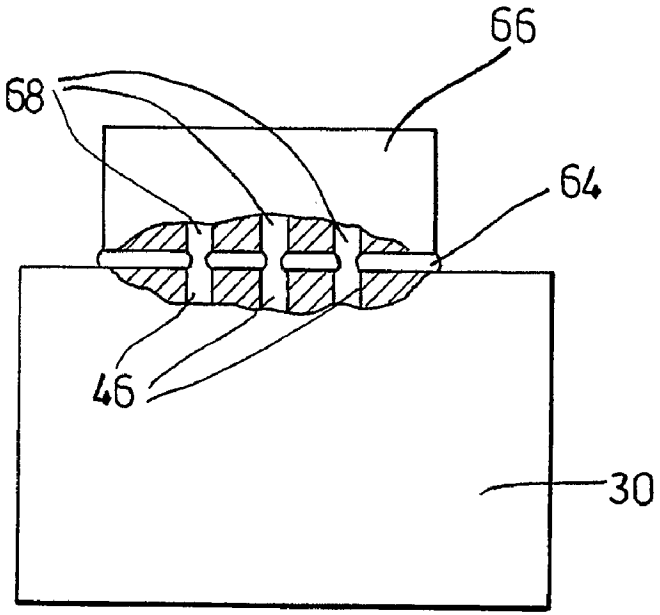
Figure 9:
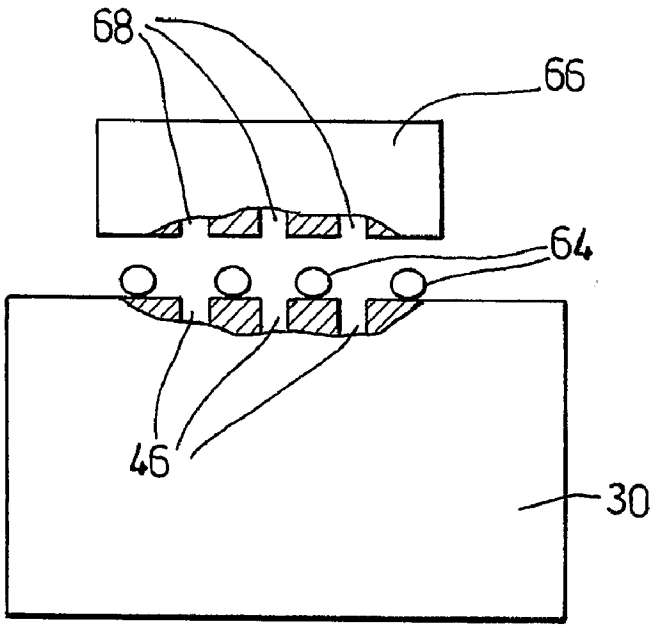

Next, FIG. 8, a structural thixotropic adhesive 64 is applied as a bead around the periphery of each ink-delivery slot 46 in the cartridge body 30. Now, FIG. 9, which is a highly schematic partially cut away side view, the underside of a printhead 66 is brought into proximity with the structural adhesive 64 on the cartridge body and ink supply slots 68 on the underside of the printhead are aligned with respective ink delivery slots 46 in the body 30 using machine vision. In this embodiment the printhead 66 is of the kind described in our copending British patent application No. 0401943.6 (HP Ref: PD No. 200315512 Attorney ref: pg10142ie00) having solder contacts (not shown) on the underside of the printhead. The printhead 66 is then driven into contact with the adhesive 64, FIG. 10, until the solder contacts on the underside of the printhead directly engage respective ones of the terminals 40*a*. Force feed-back detects such engagement and terminates further movement of the printhead relative to the body 30. A hot air gun is again used to reflow the terminals 40*a* so that they bond with the solder contacts on the underside of the printhead 66.

Figure 1:
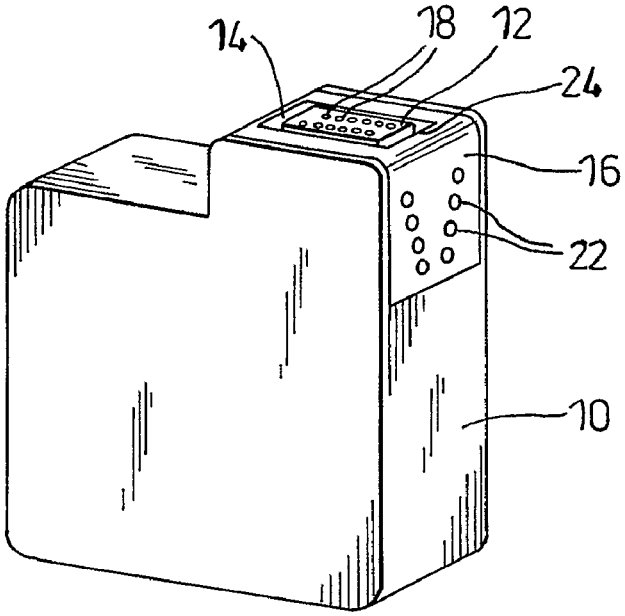
Fig. 1 (PRIOR ART)
FIG. 1 is a simplified perspective view of an inkjet print cartridge according to the prior art.
Figure 2:
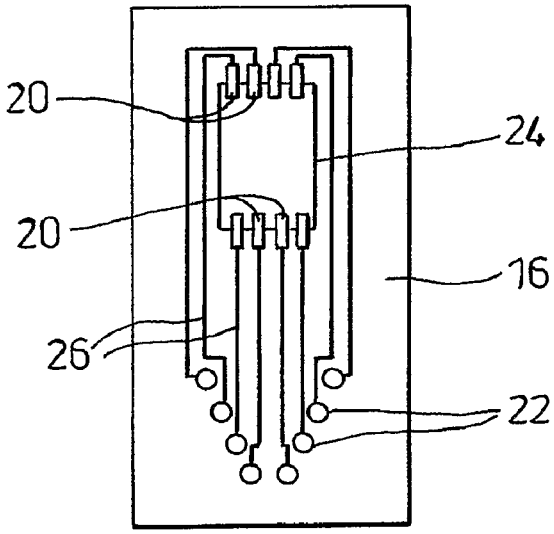
Fig. 2 (PRIOR ART)
FIG. 2 is a plan view of the underside of the flexible printed circuit used in the cartridge of FIG. 1.
Figure 12:
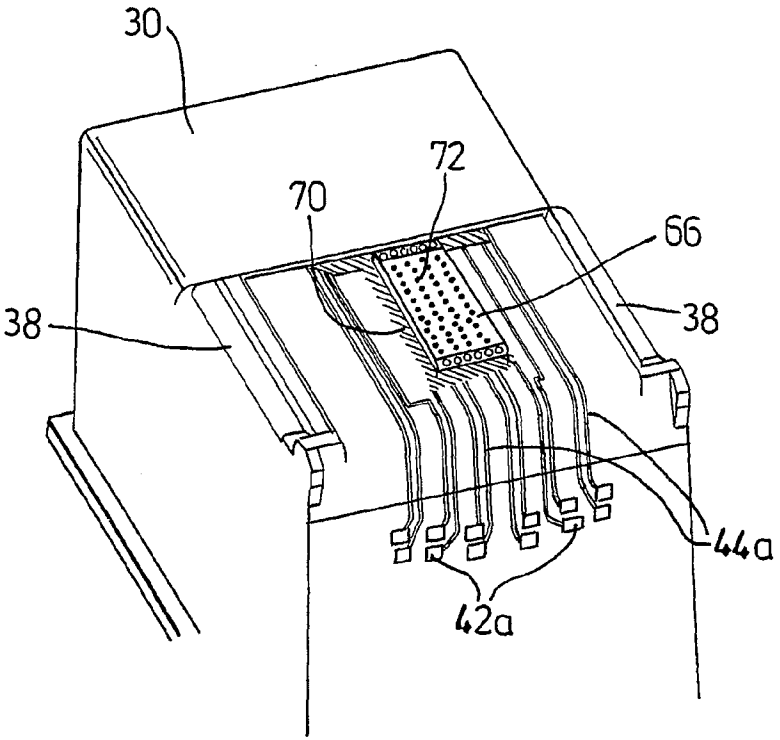
Figure 11:
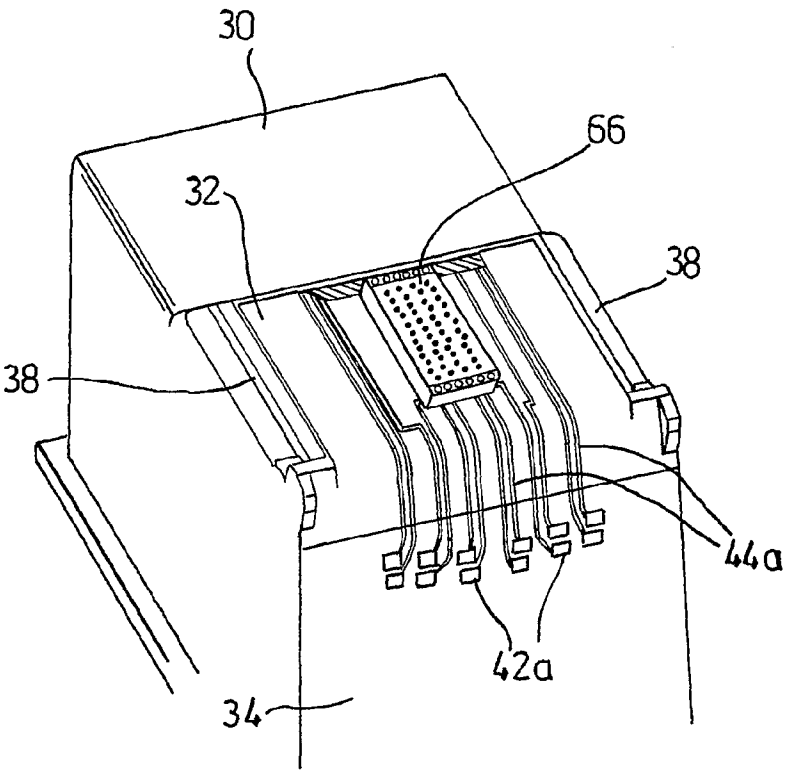

FIG. 11 shows the printhead 66 mounted on the cartridge body 30 as a result of the last step. The solder contacts on the underside of the printhead are in direct electrical contact with the terminals 40*a* (hidden from view in FIG. 11), the terminals 40*a* being selectively connected via the conductive tracks 44*a* to the terminals 42*a*. The terminals 42*a* are equivalent to the terminals 22 in the prior art (FIGS. 1 and 2), in that when the cartridge is inserted into a compatible printer, the electrical terminals 42*a* mate with corresponding electrical terminals of the printer circuitry so that the latter can selectively actuate the ink ejection elements within the printhead via the conductive tracks 44*a* and terminals 40*a*. Finally, FIG. 12, a UV curable encapsulating bead 70 is applied around the periphery of the printhead 66. In the final cartridge, as seen in FIG. 12, the exposed surface of the printhead 66 containing the orifices 72 is recessed slightly below a notional plane containing the tops of the ridges 38, to ensure a minimum clearance in use between the printhead and paper or other medium being printed upon.

In a modification of the first embodiment, the conductive material squeegeed into the terminal regions 40, 42 and channels 44 could be colloidal palladium catalyst in glycerine. Before attaching the printhead 66 this would be baked dry and plated with copper by electroless plating to form the terminals 40*a*, 42*a* and tracks 44*a*.

In a second embodiment of the invention, instead of screen printing a conductive material into the recessed terminal regions 40, 42 and channels 44 of the moulded cartridge body 30, a suspension of palladium metal catalyst is inkjet printed into the terminal regions and channels and, after drying, is electrolessly plated with copper.

Figure 13:
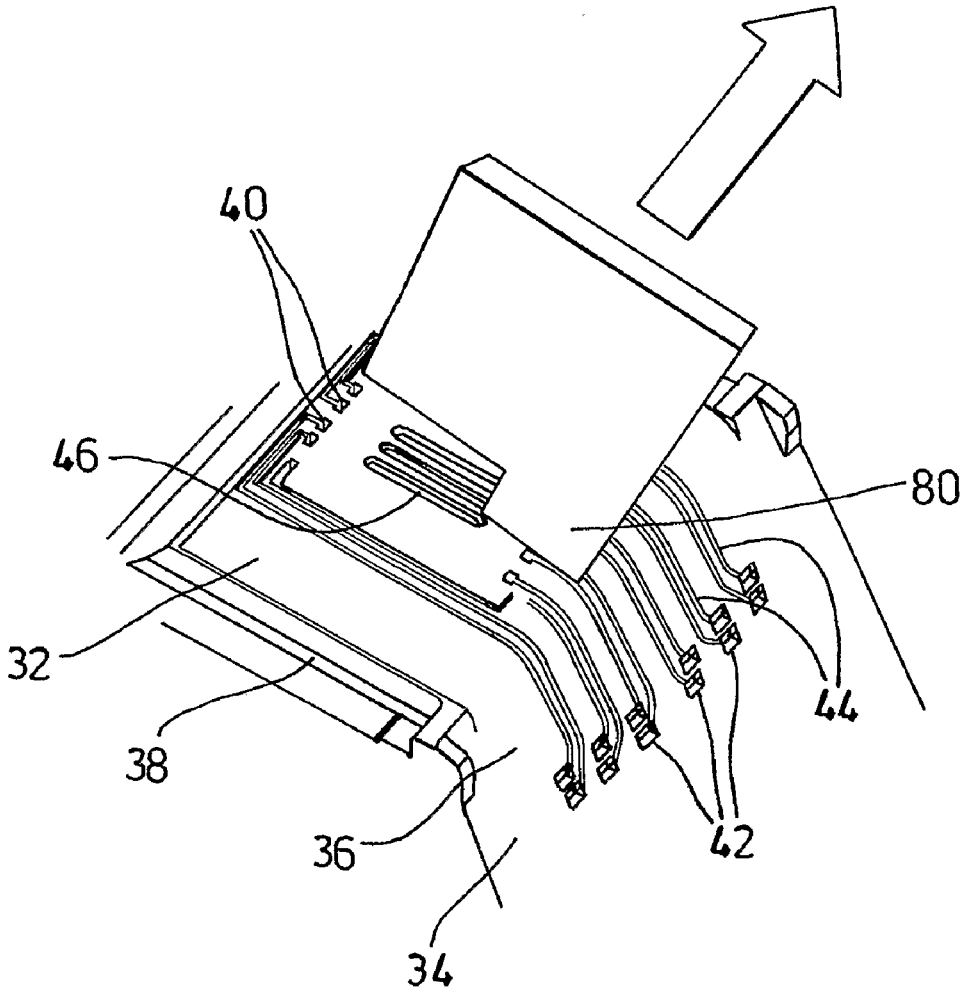
FIGS. 13 to 15 illustrate a method of making an inkjet print cartridge according to a second embodiment of the invention.
Figure 14:
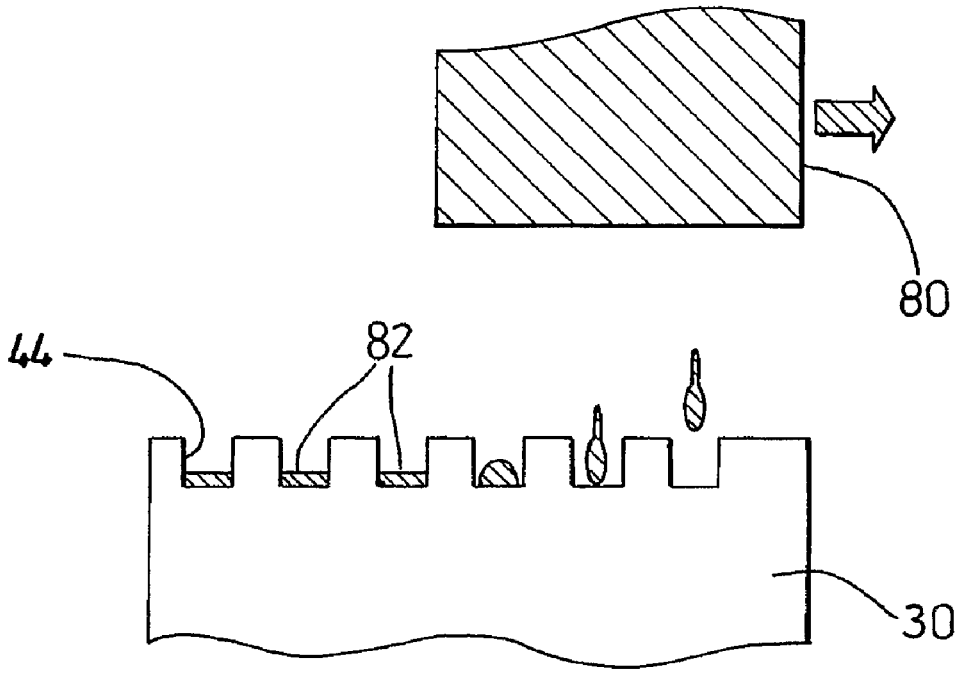

Thus, FIGS. 13 and 14, an inkjet printhead 80 is aligned to the cartridge body 30 using machine vision. The printhead 80 then scans the body 30 in a plurality of swathes and ejects ink selectively in a pattern that deposits palladium metal suspension 82 in the recessed terminal regions 40, 42 and channels 44. The printhead 80 is moved incrementally after each print swathe so that the palladium suspension is deposited in all the terminal regions 40, 42 and along the entire length of the channels 44, the body 30 being rotated when the printhead 80 is at the radiused edge 36 to ensure that deposition occurs continuously along the channels. The drop size of the suspension may typically be approximately 22 microns in diameter relative to a track width of 100 microns. After printing is complete, the fluid vehicle is removed from the palladium suspension by drying to leave a deposit of palladium particles primarily at the base of the recessed terminal regions 40, 42 and channels 44.

Figure 15:
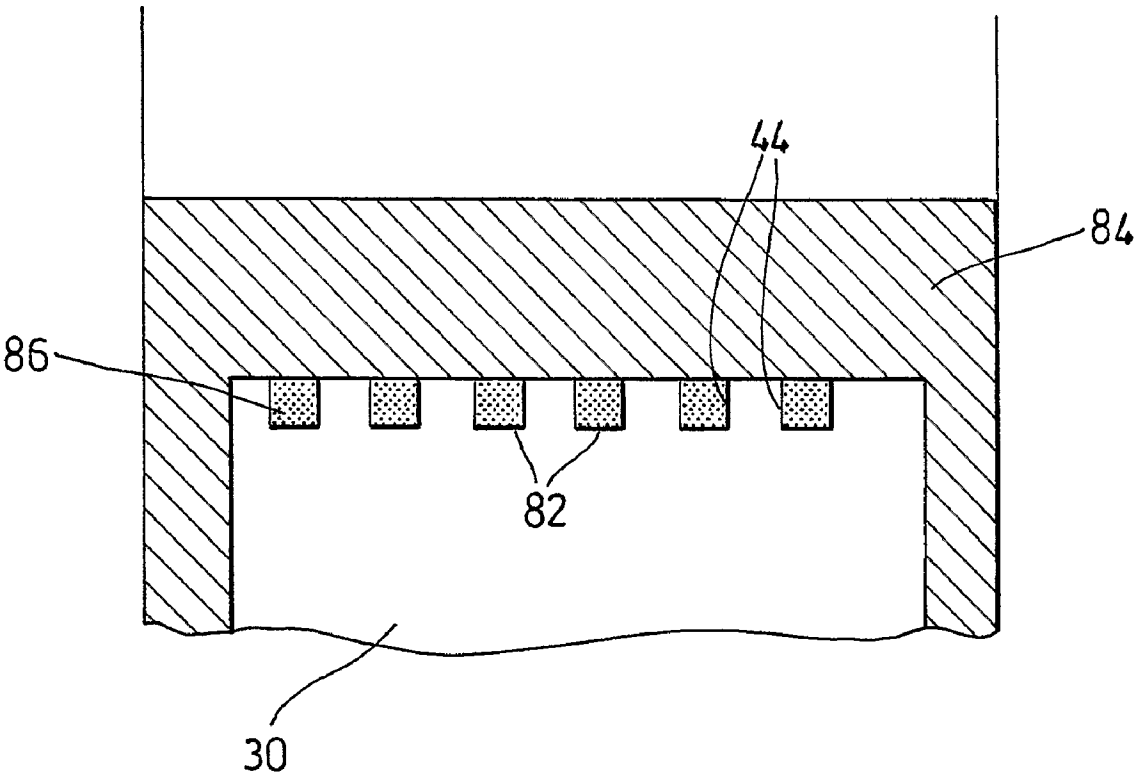

The body 30 is now immersed in a commercial electroless copper plating bath 84, FIG. 15, where spontaneous reduction of the copper solution to copper metal 86 occurs at the surface of the palladium metal 82. Electroless plating then continues on the surface of the newly deposited copper and the process is allowed to proceed until the desired thickness of copper is achieved in the recessed terminal regions 40, 42 and channels 44. Typically the terminal regions and channels would be plated until they are completely filled with copper.

During the inkjet printing of the palladium suspension, some overspray may have landed on the unrecessed portions of the cartridge body, and would act as a nucleation site for copper deposition. This may be avoided by wiping the body with a lint-free tape to remove such deposits, and repeating the process again after plating to remove any extraneous copper deposits.

Finally, a UV curable encapsulant is screen printed onto the pen body to cover the tracks 44*a* joining the terminals 40*a* and 42*a*, as previously described. The further processing then continues as described with reference to FIGS. 8 to 12 of the first embodiment.

Modifications of the second embodiment include:

(a) Inkjet printing colloidal palladium into the recessed terminal regions and tracks, baking it dry and electrolessly plating the palladium.

(b) Inkjet printing a conductive ink into the recessed terminal regions and tracks and baking it dry.

(c) Inkjet printing an organometallic copper into the recessed terminal regions and tracks, and reducing the organometallic copper to metal with a laser or excimer lamp.

The invention is not limited to the embodiments described herein which may be modified or varied without departing from the scope of the invention.

The invention claimed is:

1. A method of making an inkjet print cartridge, the method comprising the steps of:

providing a cartridge body having at least one ink delivery slot formed therein and a plurality of channels extending between a first set of terminal regions and a second set of terminal regions, the channels and the first and second sets of terminal regions being recessed in a surface of the body, one or more of the recessed channels extended parallel with and beyond opposite ends of a length of the at least one ink delivery slot, the first set of recessed terminal regions disposed in two subsets, one provided at each of the opposite ends of the length of the at least one ink delivery slot, and depositing a conductive material in the recessed terminal regions and the recessed channels, the conductive material forming conductive tracks in the recessed channels and forming first and second sets of electrical terminals in and at the first and second sets of recessed terminal regions, the first and second sets of electrical terminals selectively interconnected by the conductive tracks, the first set of electrical terminals provided at each of the opposite ends of the length of the at least one ink delivery slot, the first set of electrical terminals being adapted for electrical connection with a printhead and the second set of electrical terminals being adapted for electrical connection to printer circuitry.

2. A method as claimed in claim 1, wherein the conductive material comprises a catalyst for electroless plating, and the plating is performed electrolessly.

3. A method as claimed in claim 2, wherein the catalyst comprises palladium which is electrolessly plated with copper.

4. A method as claimed in claim 1, wherein at least a portion of the conductive material is applied to the body by inkjet printing.

5. A method as claimed in claim 4, wherein the conductive material is selectively deposited into the recessed channels and the first and second sets of recessed terminal regions by inkjet printing.

6. A method as claimed in claim 5, wherein the method further includes plating the conductive material deposited by inkjet printing.

7. A method as claimed in claim 6, wherein the conductive material deposited by inkjet printing comprises a catalyst for electroless plating, and the plating is performed electrolessly.

8. A method as claimed in claim 7, wherein the catalyst comprises palladium which is electrolessly plated with copper.

9. A method as claimed in claim 1, wherein at least a portion of the conductive material is squeegeed into the recessed channels and the first and second sets of recessed terminal regions through a stencil.

10. A method as claimed in claim 9, wherein the conductive material comprises a solder paste, and the method further includes heating the solder paste to reflow the solder therein.

11. A method as claimed in claim 10, wherein the conductive material comprises 70% by weight copper powder, having a mean particle size of 0.25 microns, and 30% by weight solder paste.

12. A method as claimed in claim 11, wherein the solder paste comprises a flux and a eutectic mixture of tin and bismuth.

13. A method as claimed in claim 1, wherein the cartridge body, including the recessed channels and the first and second sets of recessed terminal regions, is formed by molding.

14. A method as claimed in claim 1, wherein the portion of the body surface bearing the first set of electrical terminals is at an angle to the portion of the body surface bearing the second set of electrical terminals.

15. A method as claimed in claim 1, wherein each of the two subsets of the first set of recessed terminal regions are aligned perpendicular to the length of the at least one ink delivery slot.

16. A method as claimed in claim 1, further comprising:

securing the printhead to the cartridge body, including applying an adhesive bead around a periphery of the at least one ink delivery slot.

17. A method as claimed in claim 16, wherein the at least one ink delivery slot comprises at least two ink delivery slots, and wherein securing the printhead to the cartridge body includes applying the adhesive bead between the at least two ink delivery slots.

18. A method as claimed in claim 16, further comprising:

applying encapsulation around a periphery of the printhead.

19. A method of making an inkjet print cartridge, the method comprising the steps of:

providing a cartridge body having formed therein each of at least one ink delivery slot having a length, first recessed terminal regions beyond one end of the length of the at least one ink delivery slot, second recessed terminal regions beyond an opposite end of the length of the at least one ink delivery slot, third recessed terminal regions, first recessed channels extended between the first recessed terminal regions and the third recessed terminal regions, and second recessed channels extended between the second recessed terminal regions and the third recessed terminal regions, each of the first recessed channels extended substantially parallel with and beyond opposite ends of the length of the at least one ink delivery slot, and depositing a conductive material in each of the first, second, and third recessed terminal regions, and in each of the first and second recessed channels, the conductive material forming electrical terminals in and at the first, second, and third recessed terminal regions, and forming conductive tracks in the first and second recessed channels, the conductive tracks selectively interconnecting the electrical terminals, a first set of the electrical terminals adapted for electrical connection with a printhead, and a second set of the electrical terminals adapted for electrical connection to printer circuitry.

20. A method as claimed in claim 19, wherein the first set of the electrical terminals are inset in a first flat surface portion of the cartridge body at each of the opposite ends of the length of the at least one ink delivery slot and, and the second set of the electrical terminals are inset in a second flat surface portion of the cartridge body, wherein the second flat surface portion of the cartridge body is adjacent and orthogonal to the first flat surface portion of the cartridge body.

* * * * *